US006826378B2

(12) United States Patent
Ochiai

(10) Patent No.: US 6,826,378 B2
(45) Date of Patent: Nov. 30, 2004

(54) DEVELOPING DEVICE AND DEVELOPING METHOD

(75) Inventor: Norikazu Ochiai, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/370,730

(22) Filed: Feb. 24, 2003

(65) Prior Publication Data

US 2004/0165907 A1 Aug. 26, 2004

(51) Int. Cl.[7] ..... G03G 15/08
(52) U.S. Cl. ..... 399/103; 399/105; 399/119
(58) Field of Search ..... 399/102, 103, 399/105, 222, 264, 265, 119, 120

(56) References Cited

U.S. PATENT DOCUMENTS 6,181,897 B1 * 1/2001 Kawai ..... 399/103

FOREIGN PATENT DOCUMENTS

JP 2000-075592 A 3/2000

* cited by examiner

*Primary Examiner*—Hoang Ngo
(74) *Attorney, Agent, or Firm*—Foley & Lardner LLP

(57) ABSTRACT

The image forming apparatus is equipped with developer containers for housing developers and a developer carrier that is arranged at the opening of the developer container that is rotatable for supplying developer to an electrostatic latent image on an image carrier. A developing device comprising a narrow portion with an inner wall of the developer container and the developer carrier arranged closely at a point near the opening of the developer container in order to prevent leakage of the developer from the developer container is provided with a developer recovery sheet. One end of the developer recovery sheet is attached to the end of the opening of the developer container and the free end is extending in the direction of the narrow portion in the developer container and is floated up from the developer carrier when the developer carrier is turned.

17 Claims, 2 Drawing Sheets

DEVELOPING DEVICE AND DEVELOPING METHOD

BACKGROUND OF THE INVENTION

1. Field of the Invention

The present invention relates to developing device and developing method that are used in image forming apparatus such as printers, copying machines, etc.

2. Description of the Related Art

For developing devices of image forming apparatus such as printers, copying machines, etc. to obtain images according to an electro-photographic system, there is so far available an image forming apparatus provided with a narrow portion comprising developer containers and developing rollers arranged closely at a point near the opening of a developing container so as to prevent a developer in a developing container from leaking to the outside during the development or when moving a developing device and this narrow portion is blocked up by a napping of a developer formed on the surface of the developing roller. Particularly, in the case of developing devices available in recent years, that are installed to a revolver and arranged positions of them are changed by rotating them en block to supply different color developers, there is a merit to effectively prevent leakage of developers from developer containers when turning a revolver by providing the above-mentioned narrow portion.

Or, a revolver is provided with a sealing member to block up a clearance between a developing container and a developing roller at the opening of the developer container in order to prevent leakage of developer caused when turning a revolver as disclosed in Japanese Patent Publication No. 2000-75592.

However, the above-mentioned conventional developing devices so far available have not a function to recover toner scattered from carriers in a developer container when toner is separated from carrier and scattered as a result of rotation of developing roller during the developing operation. In a conventional developing device with the above-mentioned narrow portion provided, as the opening of the developer container is not blocked up by a sealing member, scattering toner is once directed to the inside of a developer container from the opening on the air flow caused from the rotation of the developing roller but bounced by the napping portion blocking the narrow portion and scatters again to the outside of the developing container. On the other hand, in a conventional developing device with a sealing member provided at the opening, scattering toner scatters in the periphery without solely taking in a developing container and contaminates periphery equipment or adversely affecting images.

Accordingly, it is desired so far to obtain a developing device that is capable of certainly recovering scattering toner generated when turning a developing roller in a developer container, preventing toner to scatter in the periphery of developing device, obtaining clear images without contaminating peripheral equipment and images by attaching scattering toner to them and reducing frequency of maintenance.

SUMMARY OF THE INVENTION

An object of the present invention is to provide a developing device and a developing method without generating contamination of the periphery by scattering toner by recovering scattering toner generated during the developing operation in developing containers and preventing scattering of toner in the periphery.

According to an embodiment of the present invention, in the image forming devices comprising developer containers for housing developers, rotatable image carriers for supplying developers to electrostatic latent images formed on an image carrier and a narrow portion provided with an inner wall of the developer container and the developer carrier arranged closely at a point near the opening of the developer container, a developer recovery sheet that floats from the developer carrier when turning the carrier is provided, of which one end is attached to the end of the opening of the developer container and the free end is extended in the direction of the narrow portion in the developer container.

Further, according to the embodiment of the present invention, in a developing method using the developing devices provided with the narrow portion comprising the inner wall of the developer container and a rotatable developer carrier closely arranged at a point near the opening of the developer container, the developer recover sheet of which one end is attached to the end of the opening of the developer container and the free end is extended in the direction of the narrow portion in the developer container floats from the developer carrier.

DETAILED DESCRIPTION OF THE INVENTION

Figure 1:
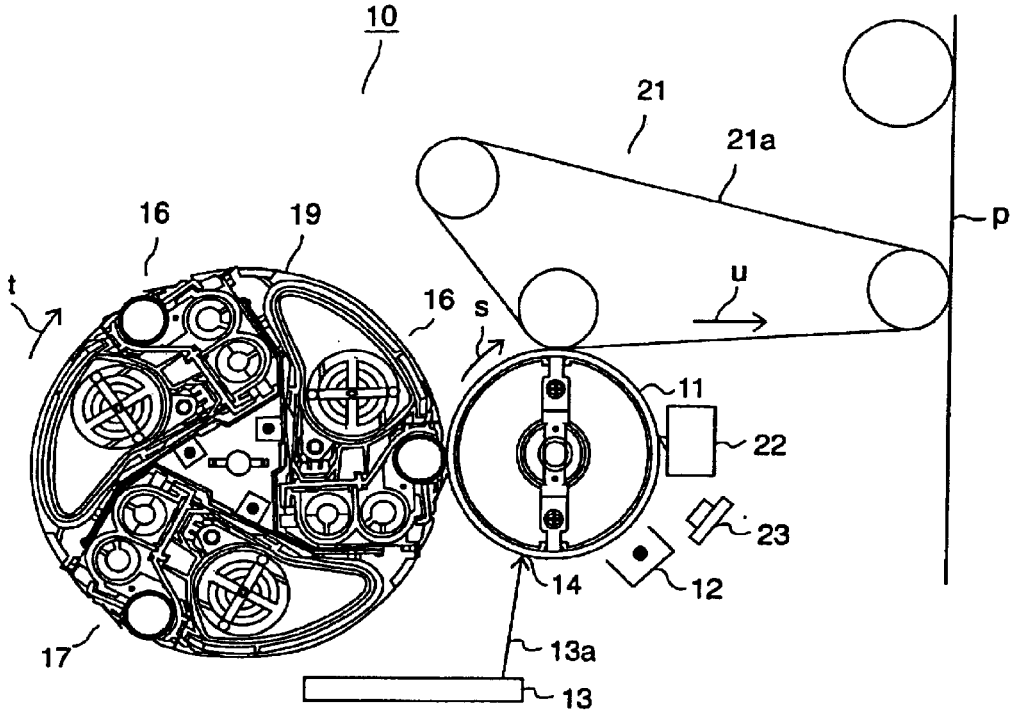
FIG. 1 is a schematic diagram showing an image forming unit of an image forming apparatus in an embodiment of the present invention.

An embodiment of the present invention will be described below in detail referring to attached drawings. FIG. 1 is a schematic diagram showing an image forming unit 10 of an image forming apparatus of an embodiment of the present invention. Around a photosensitive drum 11 that is an image carrier of the image forming unit 10, there are arranged a charger 12 for uniformly charging the photosensitive drum 11 in order with the rotation of the photosensitive drum 11 in the arrow direction s, a laser beam applying position 14 to apply a laser beam 13*a* from a laser writing unit 13 from a latent image forming unit for forming a latent image on the charged photosensitive drum 11, a revolver 19 that is provided with yellow (Y), magenta (M) and cyan (C) developing devices 16, 17, 18 and turns in the arrow direction t, an intermediate transferring unit 21 that has an intermediate transferring belt 21*a* that rotates in the arrow u direction, a cleaner 22 and a charge elimination lamp 23.

Figure 2:
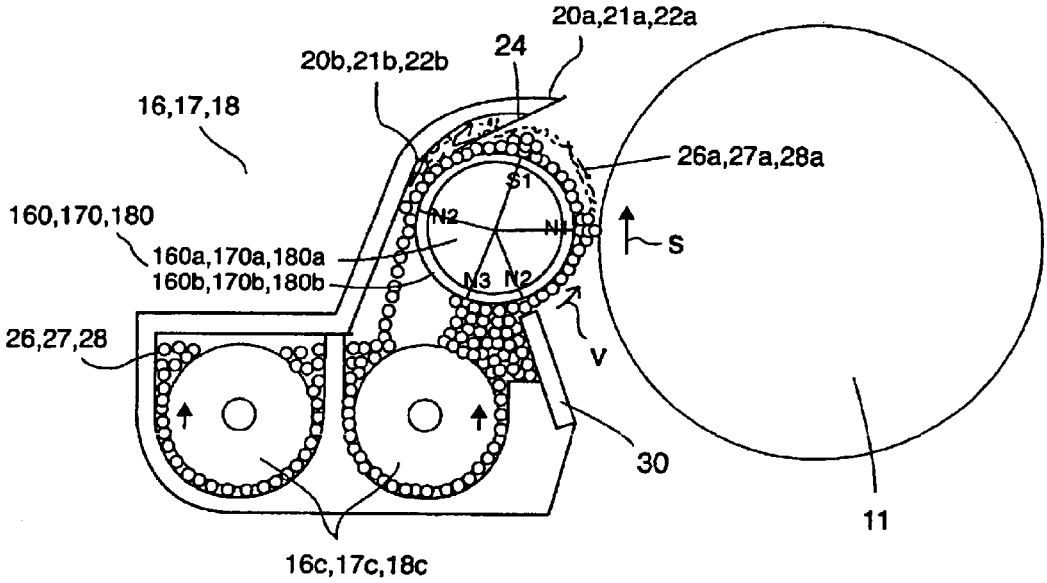
FIG. 2 is a schematic diagram showing developing devices of an embodiment of this present invention.

The laser writing unit 13 forms an electrostatic latent image on the photosensitive drum 11 by applying laser beams corresponding to writing signals for respective colors according to image data that are input through an external computer terminal or others. As shown in FIG. 2, the developing devices 16, 17 and 18 house developers 26, 27 and 28 comprising 3 color toners of yellow (Y), magenta (N) and cyan (C) and carrier in developer containers 20, 21 and 22, respectively. The revolver 19 turns the yellow (Y), magenta (M) and cyan (C) developing devices 16 to 18 all together by its rotation and arranges desired developing devices 16 to 18 at positions opposing to the photosensitive drum 11.

The yellow (Y), magenta (M) and cyan (C) developing devices 16 to 18 have magnet rollers 160*a* to 180*a*, developing rollers 160 to 180 comprising developing sleeves 160*b* to 180*b* which turn around the magnet rollers 160*a* to 180*a*, and conveying augers 16*c* to 180*c* which supply yellow (Y), magenta (M) and cyan (C) toners in the developer containers 20 to 22, respectively. The developing sleeves 160*b* to 180*b* of the developing rollers 160 to 180 turn at a speed of 340 mm/sec. in the arrow direction during the developing operation.

At the mounting ends 20*a*, 21*a* and 22*a* that are the openings of the developer containers 20, 21 and 22 at the downstream side in the arrow direction v of the developing rollers 160 to 180, one end of a urethane sheet 24 that is a developer recovering sheet in 0.1 mm thickness and JIS A90 hardness is mounted. The mounting ends 20*a*, 21*a* and 22*a* of the developer containers 20, 21 and 22 form an angle of 30° with a horizontal line passing through the center of rotation of the developing rollers 160 to 180.

Figure 3:
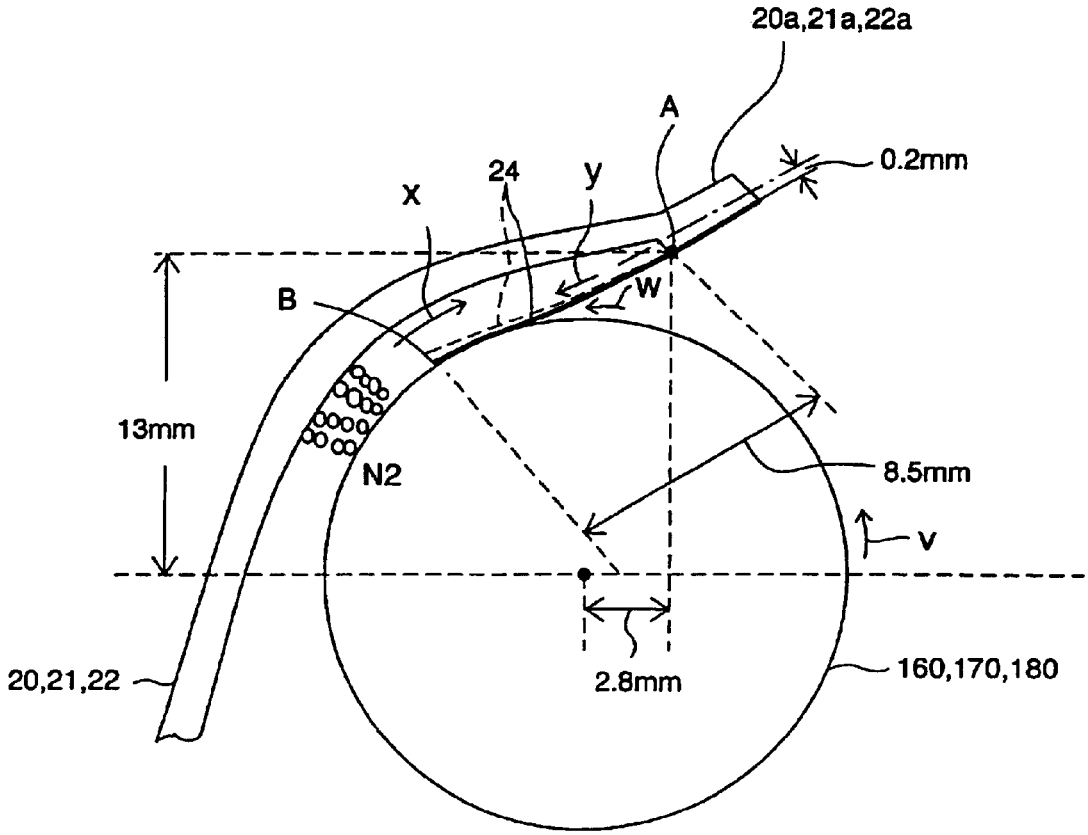
FIG. 3 is a construction diagram showing a urethane sheet of the developing device of an embodiment of the present invention.

The urethane sheet 24 is attached to the mounting ends 20*a*, 21*a* and 22*a* up to the point A shown in FIG. 3 and the portion from the point A is in the free state. The point A is at the position 2.8 mm in the vertical direction and 13 mm in the horizontal direction from the center of rotation of the developing rollers 160 to 180. The free length of the free portion from the point A of the urethane sheet 24 to the free end point B is set at 8.5 mm. Further, the urethane sheet 24 is in contact with the developing rollers 160 to 180 in the somewhat bent state when the developing rollers 160 to 180 are kept stopped. The bent amount of the urethane sheet 24 is so designed that the mounting ends 20*a*, 21*a* and 22*a* thrusts by into the tangent line of the developing rollers 160 to 180 shown by one-dot chain line in FIG. 3 by about 0.2 mm.

At the end portion of the opening opposing to the mounting ends 20*a*, 21*a* and 22*a*, a doctor blade 30 is provided to control developers 26 to 28 on the developing rollers 160 to 180. The magnet rollers 160*a* to 180*a* have a developing pole N1 opposing to the photosensitive drum 11 at the developing position, a conveying pole S1 to convey the used developers 16 to 28 into the developer containers 20 to 22, a separation pole N2 to separate the developers 26 to 28 from the developing rollers 160 to 280, a grasping pole N3 to grasp new developers 26 to 28 supplied from the conveying augers 16*c* to 18*c* at the sides of the developing rollers 160 to 180, and a layer forming pole S2 opposing to the doctor blade 30.

Near the mounting ends 20*a*, 21*a* and 22*a* of the developer containers 20 to 22, a wide clearance is formed between the developing rollers 160 to 180 to make it easy to take in the developers 26 to 28 after used for development. Further, at the upper stream side of the separation pole N2 of the developer containers 20 to 22, narrow portions 20*b* to 22*b* having a narrow clearance from the developing rollers 160 to 180 is formed. The narrow portions 20*b* to 22*b* are blocked by the rise of developers 26 to 28 formed on the developing rollers 160 to 180 in order to prevent scattering of the developers 16 to 18 from the developer containers 20 to 22.

Next, the color image forming process by the image forming unit 10 will be explained. In this image forming unit 10, a full color image is formed by superposing yellow (Y), magenta (M) and cyan (C) toner images in this order. When starting the image formation, the developing roller 160 of the yellow (Y) developing device 16 mounted to the revolver 19 is arranged opposing to the developing position of the photosensitive drum 11.

When the image forming process starts, the photosensitive drum 11 turns in the arrow direction s and uniformly charged by the charger 12 with its rotation, applied with laser beam corresponding to an yellow image signal by the laser writing unit 13 at a laser beam apply position 14. Then, an electrostatic latent image of a yellow image is formed on the photosensitive drum 11 and the drum reaches the revolver 19. At the revolver 19, the developing sleeve 160*b* of the developing roller 160 of the yellow developing device 16 turns in the arrow direction v at a velocity of 340 mm/sec.

With this rotation of the developing sleeve 160*b*, the developing roller 160 controls the rise of the developer 26 obtained by the grasping pole N3 by the doctor blade 30. And a yellow (Y) toner image is formed on the photosensitive drum 11 by giving a toner to an electrostatic latent image. Thereafter, the developer on the developing roller 160 is conveyed into the developer container 20 by the conveying pole S1 and separated from the surface of the developer sleeve 160*b* by the separation pole N2 through the narrow portion 20*b*.

During the developing roller 170 in rotating, the free end point B of the urethane sheet 24 is floated from the surface of the developing roller 160 as shown by the dotted line in FIG. 3 by the wind pressure caused from the rotation of the developing roller 160. In the clearance between the developing roller 160 and the urethane sheet 24, the air flow is generated in the arrow direction w, and when toner 26*a* is separated from carrier and scattered when the developing roller 160 is rotating, the scattering toner 26*a* is taken in the developer container by the air flow in the arrow direction w.

The scattering toner 26*a* taken into the developer container 20 is bounced by the developer 26 blocking the narrow portion 20*b* in the direction reverse to the arrow direction w. This bounced scattering toner 26*a*, however, is carried to the urethane sheet side along the inner all of the developer container 20 as shown by the arrow mark x without being scattered to the outside of the developer container 20. The scattering toner carried to the urethane sheet 24 side is bounced by the urethane sheet 24 in the developer container 20, carried in the arrow direction y and then, carried again to the narrow portion 20*b* of the developer container together with the scattering toner 26*a* that is newly taken into the developer container on the air flow in the arrow direction w. Meanwhile, the scattering toner 26*a* is conveyed in the direction of the separation pole N2 jointly with the toner at the narrow portion 20*b* along the rotation of the developing roller 160.

After completing the developing, the toner image on the photosensitive drum 11 reaches the contacting position with the intermediate transferring belt 21*a* that is rotating in the arrow direction u and is electrostatically transferred primarily on the intermediate transferring belt 21*a*. After completing the primary transfer, the photosensitive drum 11 is cleaned to remove residual toner by the cleaner 22 and the surface charge is eliminated by the charge elimination lamp 23. Then, the magenta and cyan toner image forming process is repeated on the photosensitive drum 11 in the same manner as the above-mentioned yellow toner image forming process, and yellow (Y), magenta (M) and cyan (C) toner images are transferred intermediately on the intermediate transferring belt 21*a* from the photosensitive drum 11. Thus, a color toner image with 3 color toner images superposed is formed on the intermediate transferring belt 21*a*.

Meanwhile, the revolver 19 turns sequentially in the arrow direction t and arranges the developing rollers 160 to 180 corresponding to a color of a toner image that is formed on the photosensitive drum 11 opposing to the photosensitive drum 11. When the revolver 19 is turning, the developing rollers 160 to 180 are kept stopped to turn. Yellow (Y), magenta (M) and cyan (C) color toner images superposed on the intermediate transferring belt 21*a* are secondarily transferred in block on a recording paper, etc. and a color image is completed.

While the image forming process is thus repeated, scattering toner generated when the developing rollers 160 to 180 are turning is recovered in the developer container 20 through the clearance between the urethane sheet 24 closing the opening of the developer container and the developing rollers 160 to 180 without scattering in the periphery of the developing devices 16 to 18.

Further, as a comparison example, the image forming process was executed by changing the urethane sheet 24 in this embodiment with a 0.2 mm thick urethane sheet. As a result, the free end of the urethane sheet was not floated by the wind pressure at the time of rotation but kept in contact with the developing rollers 160 to 180, and the opening of the developer container 20 was closed by the urethane sheet and the toner is scattered in the periphery without being recovered in the developing container.

According to this embodiment, toners 26*a* to 28*a* scattered from the developing roller 160 to 180 at the time of development are taken into the developer container 20 through the clearance between the urethane sheet 24 and the developing rollers 160 to 180 and further, the scattering of toner again to the outside from the developing container 20 is prevented by the urethane sheet 24. Accordingly, high grade images are obtained without contaminating peripheral equipment and images by the scattering toners 26*a* to 28*a* and further, frequencies of maintenance for removing scattering toner can be reduced.

Further, the present invention is not restricted to the embodiment described above but can be modified variously within the spirit and scope of the present invention. For example, the developing devices are not limited to those attached to a revolver but a stationary developing device is usable provided that recovery of scattering toner is required using a developer recovery sheet. In addition, the shape of the developer container is not limited but the rotating velocity of the developer carrier is also optional. Material, thickness, shape or mounting angle, etc. of a developer recovery sheet is not limited provided that it is floated by the wind pressure generated when a developer carrier is turning.

Further, when images are developed by installing plural developing devices to the revolver, using toner colors are not limited and the number of developing devices that are installed to the revolver can be four with a black toner developing device added.

According to the present invention as described above, a developer recovery sheet that floats when turning the developer carriers is provided, scattering toner is taken into the developer container by the air flow when turning developer carriers and taken scattering toner is prevented to scatter again from the developer container by the developer recovery sheet. Accordingly, high grade formed images are obtained without contaminating peripheral equipment and images when developing and frequency of maintenance for removing scattered toner adhered to peripheral equipment can be reduced.

What is claimed is:

1. A developing device comprising:

a developer containers to contain developer;

a rotatable developer carrier arranged at an opening of the developer container to supply the developer to an electrostatic image on an image carrier;

a narrow portion formed by arranging the developer container and the developer carrier closely at a point near the opening of the developer container to prevent leakage of the developer from the developer container; and a developer recovery sheet of which one end is attached to the end of the opening of the developer container and a free end is extending in the narrow portion in the developer container and being floated from the developer carrier when the developer carrier is rotated, wherein the developer recovery sheet is attached to the end of the opening of the developer container at the upper stream than the free end in the revolving direction of the developer carrier and the free end is floated from the developer carrier by the wind pressure generated when the developer carrier is turned.

2. The developing device according to claim 1, wherein plural developer containers are attached to a revolver that changes the arranged positions of the plural developer containers by turning the plural developer containers.

3. The developing device according to claim 1, wherein the developer recovery sheet is an about 0.1 mm thick urethane sheet.

4. The developing device according to claim 1, wherein the developer is magnetic developer, the developer carrier is magnet roller, and the narrow portion is blocked up by the napping of the magnetic developer formed on the magnet roller surface.

5. The developing device according to claim 4, wherein the napping of the magnetic developer is formed on the surface of the magnetic roller after passing the narrow portion and is separated from the surface of the magnetic roller at a position above a horizontal line passing a revolving center of the magnetic roller.

6. A developing method using a developing device comprising a narrow portion with an inner wall of a developer container and a rotatable developer carrier arranged closely at a position near an opening of the developer container, characterized in that one end of the developer recovery sheet is attached to the end of the opening of the developer container and the free end is extending in the direction of narrow portion in the developer container is floated from the developer carrier when the developer is supplied to an electrostatic latent image on the image carrier by rotating the image carrier, wherein the free end of the developer recovery sheet is floated from the developer carrier by the wind flow generated when the developer carrier is rotated.

7. The developing method according to claim 6, wherein plural developer containers are attached to a revolver that changes the arranged positions of the plural developer containers by turning the plural developer containers.

8. The developing method according to claim 6, wherein the developer recovery sheet is made of an about 0.1 mm thick urethane sheet.

9. The developing method according to claim 6, wherein the developer is a magnetic developer, the developer carrier is a magnetic roller, and the narrow portion is blocked up by a napping of the magnetic developer formed on the surface of the magnetic roller.

10. The developing method according to claim 9, wherein the magnetic developer that forms the napping on the surface of the magnetic roller after passing the narrow portion is separated from the surface of the magnetic roller at a position above the horizontal line passing a revolving center of the magnetic roller.

11. A developing device for use with an image forming apparatus having an image carrier, the developing device comprising:

at least one developer container that contains developer, the developer container having an opening;

a rotatable developer carrier positioned arranged adjacent the opening of the developer container, for supplying the developer to an electrostatic image on an image carrier;

a narrow portion in the developer container, formed between the developer container and the developer carrier adjacent the opening of the developer container; and a developer recovery sheet having a first end attached to the developer container, and a second end freely extending in the narrow portion in the developer container, wherein the free end of the developer recovery sheet is floated from the developer carrier by wind pressure generated when the developer carrier is rotated.

12. The developing device according to claim 11, comprising a plurality of developer containers attached to a revolver, wherein the revolver rotates to change the arranged positions of the plural developer containers relative to the image carrier.

13. The developing device according to claim 11, wherein the developer recovery sheet is an about 0.1 mm thick urethane sheet.

14. The developing device according to claim 11, wherein the developer is magnetic developer, the developer carrier is a magnet roller, and the narrow portion is blocked by the napping of the magnetic developer formed on the magnet roller surface.

15. The developing device according to claim 14, wherein the napping of the magnetic developer is formed on the surface of the magnetic roller after passing the narrow portion and is separated from the surface of the magnetic roller at a position above a horizontal line passing a revolving center of the magnetic roller.

16. The developing device according to claim 11, wherein, in a stopped position of the developer carrier, the developer recovery sheet is bent radially outward by the developer carrier.

17. The developing device according to claim 16, wherein the developer recovery sheet is bent radially outward by about 0.2 mm.

* * * * *